United States Patent [19]

Laird

[11] Patent Number: 4,620,332

[45] Date of Patent: Nov. 4, 1986

[54] BATHTUB SPLASH COLLECTOR

[76] Inventor: Owen A. Laird, 219 E. Main St., Bethalto, Ill. 62010

[21] Appl. No.: 790,897

[22] Filed: Oct. 24, 1985

[51] Int. Cl.[4] ..... A47K 3/00

[52] U.S. Cl. ..... 4/559; 4/546; 4/605; 4/609

[58] Field of Search ..... 4/608, 546, 609, 559, 4/661, 605

[56] References Cited

U.S. PATENT DOCUMENTS

| | | | |
|---|---|---|---|
| 1,791,696 | 2/1931 | Alexander | 4/609 |
| 1,971,802 | 8/1934 | Zechiel | 4/609 |
| 3,984,880 | 10/1976 | Schrameyer | 4/609 |
| 4,333,187 | 6/1982 | Schuler | 4/608 |
| 4,473,911 | 10/1984 | Germain | 4/609 |

FOREIGN PATENT DOCUMENTS

| | | | |
|---|---|---|---|
| 217662 | 10/1961 | Austria | 4/609 |

*Primary Examiner*—Henry K. Artis
*Attorney, Agent, or Firm*—Harvey B. Jacobson

[57] ABSTRACT

Splash collection apparatus for a bathtub comprising an elongate channel applied to an outside longitudinal wall of the bathtub below the rim, the channel having an open end and a base wall inclined downwardly toward the open end, and a collector cup on a stand secured to the bathtub under the open end of the channel. The apparatus is found to be effective in collecting a significant amount of water which would otherwise splash onto a bathroom floor.

9 Claims, 3 Drawing Figures

BATHTUB SPLASH COLLECTOR

BACKGROUND OF THE INVENTION

This invention relates to bathtub fittings and the like, more particularly to a splash collector for a bathtub.

It has been found that when bathing or showering in a conventional bathtub, a significant amount of water may collect on the rim of the tub and/or run down the side of the tub wetting the floor. This is true even when showering with a shower curtain which is diligently placed inside of the tub. Accordingly, the present invention seeks to provide an apparatus which, to a large extent, collects such water and prevents same wetting the bathroom floor.

SUMMARY OF THE INVENTION

The invention provides a bathtub splash collector comprising an elongate channel with an inclined base adapted to be secured, for example by adhesive, along one side of the bathtub adjacent the rim, and a collector cup on a stand which is also adapted to be secured to the side of the tub so as to collect water running down the channel. It is found that the channel, which may run substantially the entire length of the tub, need only be about a half inch in width to collect a significant amount of bath water which would otherwise splash on the floor.

The stand is secured to the tub below the outlet end of the channel or alternatively may be formed integrally with the channel. The cup may be sized to be a stable fit on the stand so that it is not easily dislodged therefrom accidentally, but may still be readily removed when filled. The apparatus may be made in a variety of suitable materials, for example molded plastic, and may be supplied with contact adhesive on one surface covered by release paper. The device lends itself to application on either side of the bathtub.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
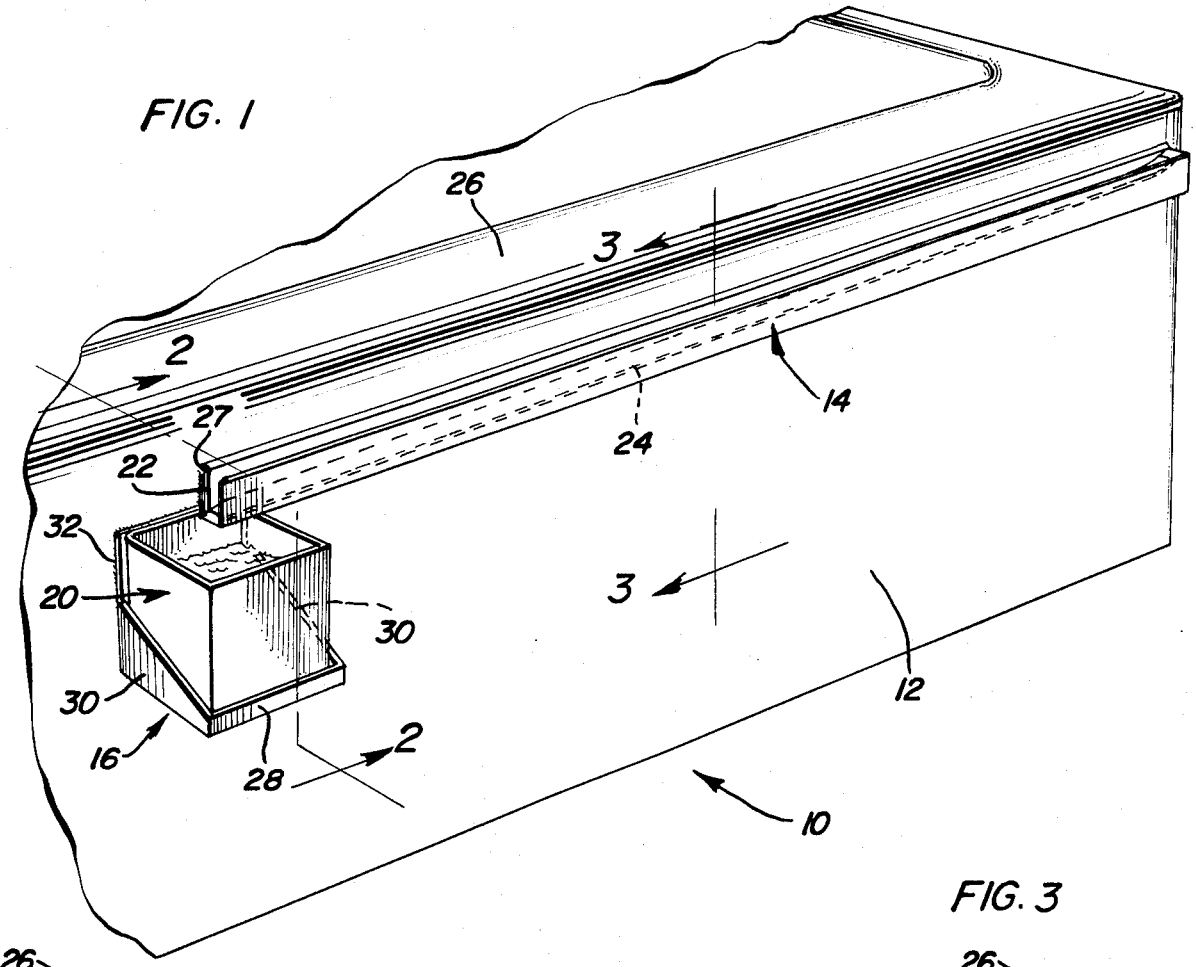
FIG. 1 is a perspective view of a bathtub fitted with a splash collector in accordance with the invention.
Figure 2:
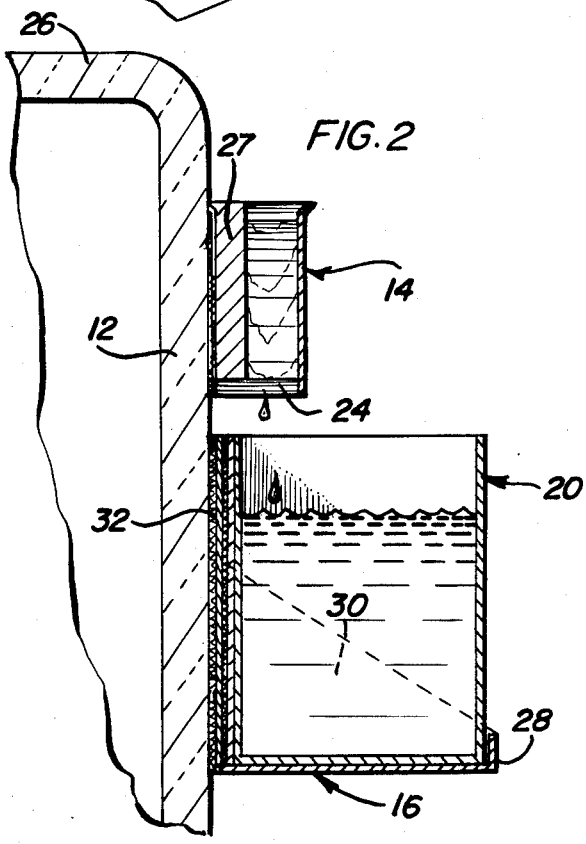
FIG. 2 is an enlarged sectional view on line 2—2 of FIG. 1.
Figure 3:
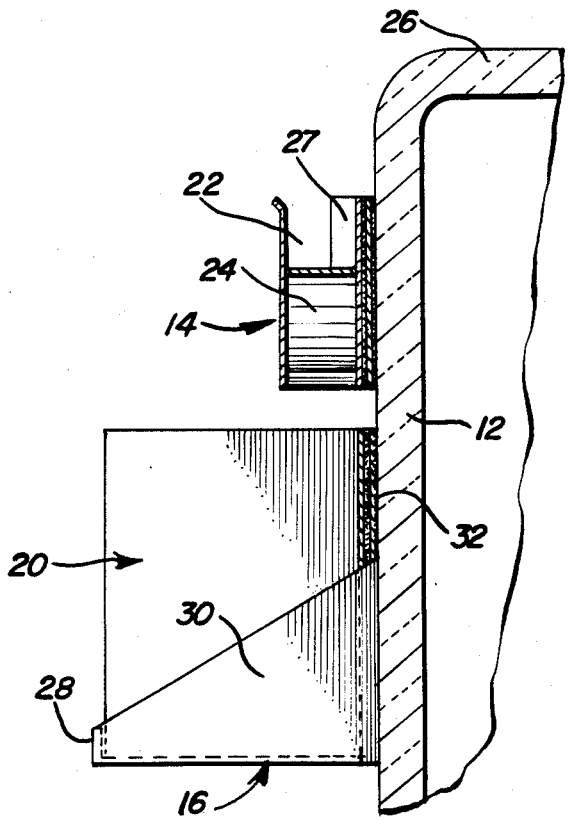
FIG. 3 is an enlarged sectional view on line 3—3 of FIG. 1.

Referring to the drawings, a bathtub 10 has a splash collecting apparatus in accordance with the invention applied along an outside longitudinal wall 12 of the tub, the apparatus comprising an elongate channel 14, a stand 16, and a cup 20.

Channel 14 is open at one end 22 and has a base wall 24 which is inclined downwardly toward the open end from the top of the closed end. (Alternatively the channel may have a straight base wall and the whole channel may be secured to the tub on a incline.) Typically, the channel may be about a half inch wide, about four feet six inches long, and about one and three quarter inch deep at end 22. It may be adhered to the bathtub about one and one half inches below rim 26. Preferably, the channel may have an inclined diverting panel 27 at its open end to divert water flowing from the channel away from the bathtub.

Stand 16 is configured so as to firmly locate cup 20 while allowing the cup to be removed when filled. To this end, the stand has a shallow front lip 28 and inclined side walls 30 extending from lip 28 to about half the height of rear wall 32 which is adhered to the tub below the open end of channel 14. For stability, the cup and stand are of complementary rectangular shape. The cup may, for example, be about one and three quarter inches by one and three-eighths inches by one and three quarter inches deep.

The components of the apparatus may be plastic moldings, for example, and the channel and stand may be adhered to the tub by contact adhesive or the like.

The device is found to be remarkably effective in collecting water from the tub which would otherwise splash on the floor substantially along the length of wall 12, the water being collected in channel 14, and running down into cup 20. When filled the cup can be readily removed, emptied and replaced.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A splash collector for a bathtub comprising an elongate channel, securement means for securing the channel along an outside wall of the tub below the rim of the tub, the channel having an open end and a base wall adapted to extend down toward the open end when the channel is secured as aforesaid, a collector cup, a stand for the collector cup, and further securement means for securing the stand to said outside wall of the tub below the open end of the channel for supporting the cup to receive water running down the channel.

2. The invention of claim 1 wherein the securement means and the further securement means comprise adhesive on respective surfaces of the channel and stand for adhering same to an outside wall of the tub.

3. The invention of claim 1 wherein the stand and the cup are of complementary rectangular cross section.

4. The invention of claim 3 wherein the stand has a rear wall for adhesion to the tub, a shallow front lip, and side walls inclined upwardly from the lip to meet the rear wall intermediate its height.

5. In combination, a bathtub, and splash collection apparatus comprising an elongate channel extending along an outside longitudinal wall of the bathtub adjacent the rim of the bathtub, the channel having an open end and a base wall inclined downwardly toward the open end, and a stand for a removable cup on the longitudinal wall of the bathtub beneath the open end of the channel, so that the cup on the stand can receive water running down the channel.

6. The invention of claim 5 wherein the channel is about a half inch wide.

7. The invention of claim 6 wherein the channel is about one and a half inches below the rim of the bathtub.

8. The invention of claim 5 wherein the stand and the cup are of complementary rectangular shape in cross section.

9. The invention of claim 5 wherein the channel has an inclined diverting panel at the open end for diverting water flowing out of the channel away from the bathtub.

* * * * *